US012473128B2

(12) United States Patent
Estabrook et al.

(10) Patent No.: US 12,473,128 B2
(45) Date of Patent: Nov. 18, 2025

(54) METHOD OF MANUFACTURE FOR A HIGHLY PEELABLE LID WITH A FRANGIBLE SEAL

(71) Applicant: Cambio Roasters, LLC, Isle of Palms, SC (US)

(72) Inventors: Richard Estabrook, Shelburne, VT (US); Kevin Hartley, Isle of Palms, SC (US)

(73) Assignee: Cambio Roasters, LLC, Isle of Palms, SC (US)

( * ) Notice: Subject to any disclaimer, the term of this patent is extended or adjusted under 35 U.S.C. 154(b) by 0 days.

(21) Appl. No.: 18/606,085

(22) Filed: Mar. 15, 2024

(65) Prior Publication Data

US 2025/0289635 A1 Sep. 18, 2025

(51) Int. Cl.

| | |
|---|---|
| ***B65B 29/02*** | (2006.01) |
| ***B65B 7/01*** | (2006.01) |
| ***B65B 7/28*** | (2006.01) |
| ***B65B 43/44*** | (2006.01) |
| ***B65B 61/02*** | (2006.01) |
| ***B65D 41/00*** | (2006.01) |
| ***B65D 53/04*** | (2006.01) |

(52) U.S. Cl.

CPC ..... *B65D 53/04* (2013.01); *B65B 7/2871* (2013.01); *B65B 7/2878* (2013.01); *B65D 41/005* (2013.01); *B65B 7/01* (2013.01); *B65B 29/022* (2017.08); *B65B 43/44* (2013.01); *B65B 61/025* (2013.01); *B65D 2251/20* (2013.01); *B65D 2565/384* (2013.01)

(58) Field of Classification Search

CPC ..... B65B 7/01; B65B 7/2871; B65B 7/2878; B65B 43/44; B65B 61/025; B65B 29/022; B65B 61/184; B65D 17/12; B65D 41/005; B65D 53/04; B65D 2251/20; B65D 2565/384; B65D 2401/05; B65D 2543/00851; B65D 2543/00879; B65D 2577/2041; B65D 2577/2058

USPC ..... 53/478, 329.3, 133.1, 133.7, 412; 220/359.4, 359.2

See application file for complete search history.

(56) References Cited

U.S. PATENT DOCUMENTS 1,834,085 A * 12/1931 Bloom ..... B65D 7/24 229/125.17
3,191,359 A * 6/1965 Stark ..... B65B 7/2878 53/316

(Continued)

FOREIGN PATENT DOCUMENTS

EP 1125852 A2 8/2001
EP 1516816 A1 * 3/2005 ..... B65B 7/2878

(Continued)

*Primary Examiner* — Stephen F. Gerrity
(74) *Attorney, Agent, or Firm* — Caldwell Intellectual Property Law

(57) ABSTRACT

The following disclosure describes a container with a peelable lid having a frangible seal and method of manufacture. The method includes providing a container body, receiving a lid, aligning and placing the lid flush against the rim of the container body, and sealing the lid to the container body. The method of manufacture produces a container with a peelable lid having a frangible seal, the container including a container body, a lid sealed to the rim of the open end of the container body, and a pull tab.

18 Claims, 8 Drawing Sheets

(56) References Cited

U.S. PATENT DOCUMENTS 3,391,847 A * 7/1968 Christine et al. .... B65D 51/185 229/125.05
3,434,651 A * 3/1969 Stec ..... B65D 3/14 229/5.5
3,508,376 A * 4/1970 Bemiss ..... B65B 7/2878 53/478
3,891,779 A * 6/1975 Robinson ..... B65B 55/027 426/399
3,908,340 A * 9/1975 Erhardt ..... B65B 7/2878 53/329.3
4,215,797 A * 8/1980 Chen ..... B65D 43/022 220/276
4,557,414 A * 12/1985 Ford et al. ..... B65D 51/20 220/359.2
4,693,390 A * 9/1987 Hekal ..... B65D 77/2056 220/359.3
4,723,391 A * 2/1988 Ashley et al. ..... B32B 27/32 53/133.1
4,832,201 A * 5/1989 Kenyon, II ..... B65D 77/2024 229/123.1
5,052,578 A * 10/1991 Goodwin ..... B65D 59/00 229/125.17
5,709,310 A * 1/1998 Kretz ..... B65D 77/2032 220/276
5,810,197 A * 9/1998 Mazzarolo ..... B65D 43/022 220/359.2
6,129,268 A * 10/2000 Stahlecker ..... B65B 61/184 220/359.2
2005/0051453 A1 * 3/2005 Schuler et al. ..... B65B 7/2878 53/329.3

FOREIGN PATENT DOCUMENTS

JP 02045337 A * 2/1990
JP 2014118162 A 6/2014
WO 2006050105 A 5/2006
WO 2007063226 A1 6/2007

* cited by examiner

METHOD OF MANUFACTURE FOR A HIGHLY PEELABLE LID WITH A FRANGIBLE SEAL

FIELD OF THE INVENTION

The present invention generally relates to the field of packaging. In particular, the present invention is directed to a container with a peelable lid having a frangible seal and method of manufacture.

BACKGROUND

In manufacturing, packaging is one of the most important aspects of a finished product. Packaging may include one or more levels of packaging including interior and exterior packaging of a product. Interior packaging may include sealing of a product which aids in ensuring freshness and in maintaining the integrity of a package's contents. Packaging processes may be specific to a particular product and may be chosen in relation to the benefits each process provides.

SUMMARY OF THE DISCLOSURE

In an aspect a method of manufacture of a container with a peelable lid having a frangible seal may include providing a container body, receiving a lid, aligning and placing the lid flush against the rim of the container body, and sealing the lid to the container body.

In another aspect the method of manufacture may produce a container with a peelable lid having a frangible seal, wherein the product includes a container body, a lid sealed to the rim of the open end of the container body, and a pull tab.

These and other aspects and features of non-limiting embodiments of the present invention will become apparent to those skilled in the art upon review of the following description of specific non-limiting embodiments of the invention in conjunction with the accompanying drawings.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION

At a high level, aspects of the present disclosure are directed to systems and methods for manufacture of a container with a peelable lid having a frangible seal. In an embodiment, a method of manufacture of a container with a peelable lid having a frangible seal may include providing a container body, receiving a lid, aligning and placing the lid flush against the rim of the container body, applying heat to the container components, applying pressure to the lid and container body components, and scaling the container body with the lid. Further, in an embodiment, a method for manufacture of a container with a peelable lid having a frangible seal may produce a container with a peelable lid having a frangible seal including a container body, a lid sealed to the container body, and a pull tab connected to the lid sealed to the container body.

Aspects of the present disclosure can be used to produce an easily peelable lid sealed to a container body. Aspects of the present disclosure can also be used to produce a pull tab configured to aid in the case of removing the lid with a frangible seal. This is so, at least in part, because of the pull tab's size, shape, and/or location in relation to the entire container embodiment.

Aspects of the present disclosure allow for an easily peelable lid with a frangible seal, sealed to a container embodiment. Exemplary embodiments illustrating aspects of the present disclosure are described below in the context of several specific examples.

Figure 1:
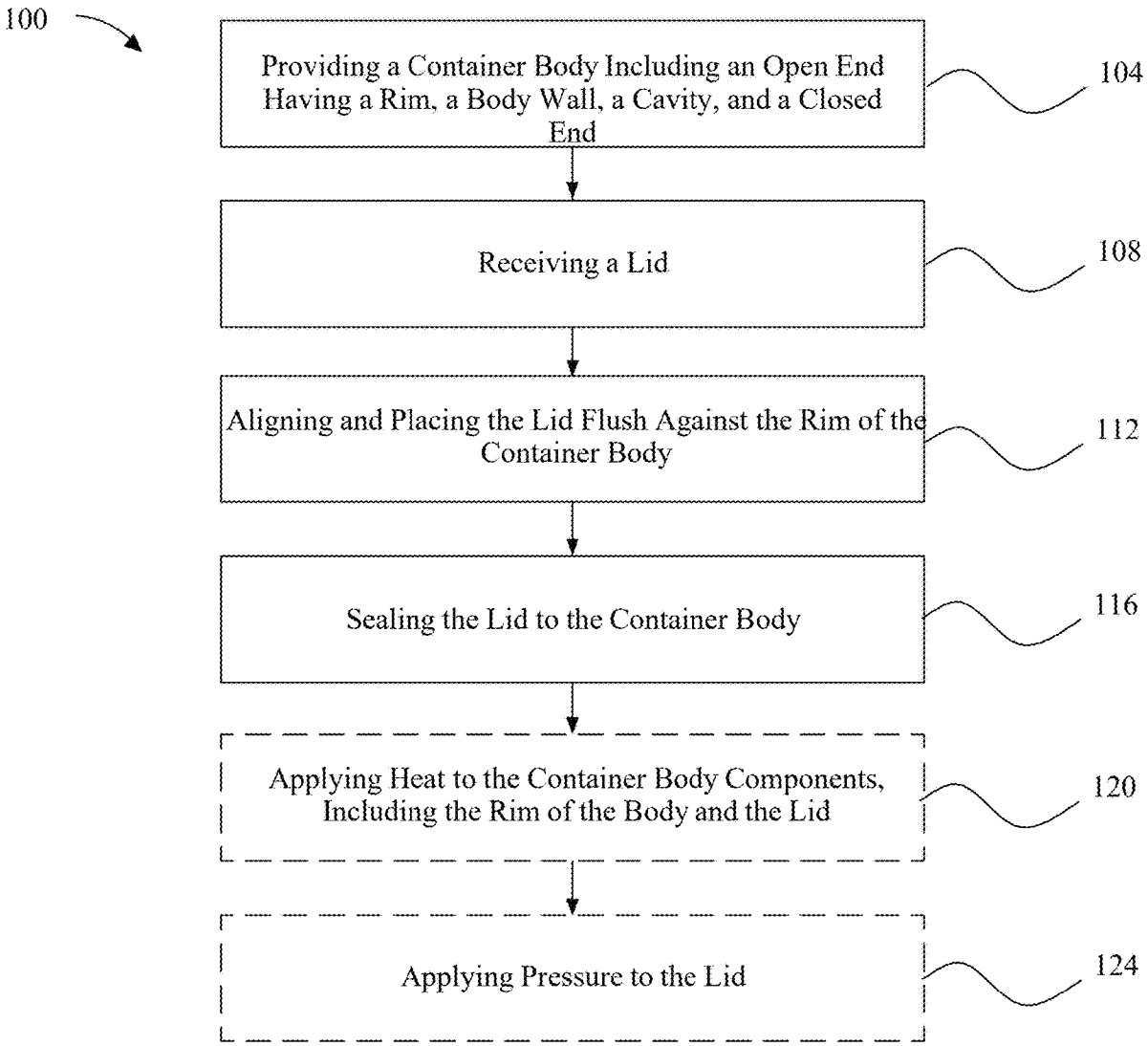
FIG. 1 is a flow diagram illustrating a method of manufacture of a container with a peelable lid having a frangible seal.

Referring now to FIG. 1, an exemplary embodiment of a method of manufacture for a container body with a peelable lid having a frangible seal is illustrated. In an embodiment, method 100 may include providing a container body having an open end including a rim with a polymer lining, a body wall, a cavity, and a closed end 104, receiving a lid 108, aligning and placing the lid flush against the rim of the container body 112, and sealing the lid to the container body 116, wherein sealing includes applying heat to the container body components 120 and applying pressure to the lid 124. Once complete, the sealed container may be removed to a secondary packaging process. As used in this disclosure, a "secondary packaging process," is a packaging process outside of the process being described. For example, and without limitation, a secondary packaging process may include any packaging process following the process as being described. This may include packaging processes for interior aspects of a product and/or exterior packaging of a product. In an embodiment, method 100 may additionally include singulation of one or more container bodies prior to receipt of a container body. Method 100 may further include the production or formation of lids. In an embodiment where method 100 includes the formation of lids, formation may include receiving a lid material, shaping the lid material, and removing the shaped lid material to a secondary packaging process. An embodiment that includes lid formation may additionally include additional steps related to labeling, such as stickering, printing, and/or stamping of the lid material. Alternatively, in an embodiment where lid formation has occurred separately, additional steps related to labeling may still be undergone. As used in this disclosure, "stickering" is the process of placing a sticker on the surface of an item. Further, some embodiments of method 100 may include de-nesting of one or more lids prior to the receipt of a lid. Method 100 produces a container with a peelable lid having a frangible seal that includes a container body, a lid with a frangible seal, and a pull tab configured to aid in the case of peeling the lid from the container body. The product of method 100 in some embodiments, may further include a filter disc disposed within the cavity of the container body, a formed filter material adhered to the interior of the body wall of the container body, and a beverage material within the formed filter material. This may be implemented, without limitation, as disclosed in U.S. application Ser. No. 18/599,862, filed Mar. 8, 2024, and entitled "HIGHLY RECYCLABLE BEVERAGE PODS AND METHOD OF MANUFACTURE" the entirety of which is incorporated herein by reference.

With further reference to FIG. 1, method 100 includes providing a container body with a peelable lid having a frangible seal. A container body with a peelable lid having a frangible seal may include a container body, a lid sealed to the rim of the open end of the container body and a pull tab. The container body may further include an opening having a rim with a polymer lining, a cavity, a body wall, and a closed end. In some cases, the rim of the container body may vary in its width. For example, and without limitation a container body configured to hold a heavier material may have a wider rim as compared to a container body configured to hold a lighter material and having a thinner rim. The rim may in some cases be thin in width, so that no difference between the container body and the rim is noticeable to the eye. For example, and without limitation this may be so in an embodiment where the lid is configured to wrap around the opening of the container body rather than sit atop it and/or inside of the container body. In some embodiments, the rim may create a lip with a ridge at the opening of the container. A "lip," as used in this disclosure is the edge of a hollow container or an opening. Further, a "ridge" refers to a surface that sticks out from the container body wall. For example, and without limitation, a ridge may extend from the container body or the intersecting horizontal plane and vertical plane at the top of the container body, across the horizontal, axial, or transverse lane. This extension may occur away from the container wall and/or towards the opposite side container wall. A ridge may be flat and/or curved over the side of the container body. Additionally, in some embodiments the rim may be recessed. "Recessed," in this instance refers to the rim being set back from the opening of the container body. The "opening" of the container body refers to the uppermost edge of the cup, which creates a shelf, internal to the container body which is below the uppermost edge of the container body. This embodiment may allow for the sealed lid to sit within the container body rather than on top of the container body. In some embodiments, the rim may embody a flat surface that is broader than the annular area of a cross-section taken from the wall of the container body. In other words, the rim may, in some embodiments, create a shelf. In some embodiments, including those previously discussed, there may be a discontinuity in the uppermost edge, this may configure the embodiment to provide a gap that the pull tab may pass through. In some embodiments, the rim may extend past the edge of the container body in a way that imitates the shape of the pull tab. In this embodiment the extended rim may provide a resting spot for the lid to sit fully atop and supported by the underlying rim. Further, in this embodiment, the extended rim may be perforated in order to allow for continued support in the removal of the peelable lid. This embodiment may allow for a portion of the rim to be removed along with the pull tab with a frangible seal. In some embodiments, the rim of the container body may include a layer of adhesive and/or polymer to aid in the sealing process of method 100. A layer may be described as a lining and/or a coating. As used throughout this disclosure a lining may vary in thickness in comparison to a coating. A lining may be thinner in comparison to a coating of polymer and/or adhesive. Alternatively, a coating of polymer may describe a thicker layer of polymer and/or adhesive. The body wall of the container body may be curved and/or cylindrical in shape. Alternatively, the body wall may be cube-like and/or prism-like shaped. The container body may be any shape and/or size, however the dimensions of the lid would necessarily need to be configured to that same size and/or shape. Furthermore, the body wall of the container body may include detents, rivets, beads, and/or any other locking/fastening means as described throughout this disclosure and/or any disclosure as herein incorporated. The container body may be made of any material as described throughout this disclosure, including without limitation glass, plastic, metal, metal alloys, and/or the like.

Continuing to reference FIG. 1, in some embodiments, a lid sealed to the rim of the open end of the container body may include a lid made of flexible packaging material. Flexible packaging material may include plastic, metals, such as aluminum, paper, and/or a mixture thereof. The lid may further include recycled materials. The size and shape of the lid may be dependent on the size of the container and/or the type of embodiment the container maintains. For example, and without limitation, a container body that is circular and small, may require a circular lid that fits the small dimensions of the container opening. Furthermore, the lid may include multiple layers of materials. For example, and without limitation, many lids functioning to keep contents of the container fresh incorporate three layers. These layers may relate to printability, seal capabilities, peelability, and/or barrier capabilities. Some of these layers may be co-extruded layers of a specific combination of polymers configured to create a seal that keeps contents fresh while allowing for easy peel of the lid from the container. As a further example, a paper layer may be laminated to allow for printing, stamping, and/or the like. In some embodiments, the lid may include an adhesive and/or a polymer layer configured to aid in the sealing process of method 100.

Further referencing FIG. 1, in some embodiments, a pull tab may be configured as part of the lid. Alternatively, the pull tab may be separate from the lid and attached in the process of method 100. In an embodiment where the pull tab is separate from the lid, the pull tab may be attached with an adhesive and/or through a separate process using polymer layers. The pull tab may extend across the entire lid through the center, around the edges, and or in another pattern capable of maintaining its integrity when force is applied. The pull tab may include plastic, paper, metal, and/or metal alloy components or threads to enhance the strength of the tab. Additionally, in either embodiment the pull tab may be incorporated into the body wall in a way that when not in use the tab may sit flush with the body wall. In some embodiments, the body wall may include a perforation that may be configured to transform into a pull tab when force is applied to it. The pull tab may also embody the ability to be printed, stamped, and or the like with text and/or images.

With continued reference to FIG. 1, method 100 produces a frangible seal that allows for easily peelable lids. This may be embodied in many variations, for example and without limitation in relation to beverage pods. Additionally, method 100 may produce a frangible seal configured to peel easily from any container body as described throughout this disclosure, including without limitation plastic containers, metal and/or metal alloy containers, recycled material containers, glass containers, and/or the like. Exemplary, nonlimiting containers may be related to food and/or beverage containers such as beverage pods, food cups, and/or the like. Alternatively, and without limitation containers may relate to other areas where an easily peelable lid is necessary for storage and/or use of a product. "Container," as used in this disclosure, is an object that can be used to hold or transport something.

Further referencing FIG. 1, method 100 includes providing a container body, wherein the container body may include an open end having a rim, a body wall, a cavity, and a closed end 104. In some embodiments, the rim of the body container may be 45-55 mm in diameter. The rim may be situated at the edge of the opening and/or alternatively set back from the opening creating a recess between the opening and the rim of the container body. An embodiment containing a recessed rim may allow the lid to sit snuggly within the container body, configured to be flush with the open end of the container body. This may be compared to an embodiment where the rim is not recessed and therefore flush with the open end of the container. In this embodiment, the lid may sit on top of the rim, therefore fully covering the container body from a top view vantage point. Furthermore, the rim in an embodiment may include an adhesive and/or polymer layer. The polymeric coating may have a specified weight and thickness. Nonlimiting exemplary embodiments of polymeric coating may include pullulan, hydroxypropyl methylcellulose, hydroxyethyl cellulose, hydroxypropyl cellulose, polyvinyl pyrrolidone, carboxymethyl cellulose, polyvinyl alcohol, sodium alginate, polyethylene glycol, xanthan gum, tragacanth gum, guar gum, acacia gum, gum arabic, polyacrylic acid, methyl methacrylate copolymer, amylose, high amylose starch, hydroxypropylated high amylose starch, dextrin, pectin, chitin, chitosan, levan, elsinan, collagen, gelatin, zein, gluten, soy protein isolate, whey protein isolate, casein, polysaccharides, natural gums, polypeptides, polyacrylates, starch, gum karaya, and/or mixtures thereof. Additionally, a co-extrusion process may be applied to any of the embodiments as described above to create a specific composition of polymers that embody desired attributes. For example, and without limitation, co-extruded polypropylene may be used as the polymer layer. "Co-extruded polypropylene," refers to a bi-orientated polymer film obtained from an extrusion process. Qualities that co-extruded polypropylene may possess are good optical qualities, a good barrier towards humidity, and a low barrier towards oxygen. Exemplary, a nonlimiting embodiment of adhesive that may be used is water-based glues, such as formulations of resin, starch glues, and/or dextrin. In some cases, the body wall may include the use of plastic, metal, metal alloys, recycled material, glass, and/or the like. In some embodiments, the cavity of the container body may contain a circular shape, a cylindrical shape and/or any cup-like shape. In some embodiments, the cavity of the container body may be described by way of cross-sectional shapes. A "cross-sectional shape" is found when cutting an object parallel to its base with a plane. When an object is cut parallel to its base, the cross-section may be similar to the shape of the base, such as in a square pyramid, where the cross-section will be a square shape. The cross-section of the container body may be any combination of curved and polygonal forms. For example, and without limitation, square, triangular, pentagonal, hexagonal, and/or the like. In some cases, the cavity may include a singular opening. The closed end of the container body may, in some embodiments, contain indentations to assist in later use of the particular product.

With further reference to FIG. 1, providing a container body 104 may include incorporating a container body from another method of manufacture. Additionally, the provided container body may have fully undergone a process of filling of the container body with any specific product. In a nonlimiting example, the specific product may include food and/or beverage materials and/or product associated therewithin. Furthermore, method 100 may further require the singulation of one or more container bodies. The singulation process may allow for an individual container body to be selected out of a larger batch of container bodies and processed independently of the overall batch of container bodies. "Singulation," as used within this disclosure, is the manufacturing process configured to take a group of side-by-side products and form them into a straight line with the proper justification. This may be accomplished using any manufacturing system as described here within and/or manually. Proper justification may be determined by a user and/or a specific method or process the manufacturing system is configured to undertake. Proper justification may be accomplished by placing container bodies into a manufacturing device configured to hold products throughout the manufacturing process and deliver the product to the next step of the process. In some embodiments, proper justification may be precise and may align polymer coating and/or lining up with the specific embodiment of rim and/or lid embodiment as used in the specific embodiments of either lid or rim. In some embodiments, singulation may be a direct step from the de-nesting process and may further include the dropping down of a container body into a receptacle configured to hold the container body and transport it to the next step in the process. Proper justification may be accomplished based on specific variations in the container body. For example, in an embodiment that furnishes an extended lid the extended lid may be the point of interest in determining the proper justification within the manufacturing device.

Continuing to reference FIG. 1, method 100 includes receiving a lid 108. A lid may be received from a prior lid formation process as described below and/or from a preformed lid supply. "Preformed," as used here is in relation to the lids being pre-shaped and prepared in a separate process. In either embodiment, de-nesting of one or more lids may be necessary. In an embodiment where de-nesting is necessary a de-nesting process may accompany method 100. As used in this disclosure, "de-nesting" refers to the process of removing one or more lids from a stack of one or more lids. In some cases, one or more lids may be shaped and efficiently stacked prior to receipt. In some cases, de-nesting of one or more lids may include the use of a de-nesting machine. A "de-nesting machine," as used in this disclosure is an automated machine designed with accuracy, reliability, and improved effectiveness in de-nesting. De-nesting machines may automate the manual repetitive task of separating and setting a lid on a conveyor line and/or on another component of the manufacturing process, such as the container body. Exemplary, nonlimiting embodiments of a de-nesting system may include a peel de-nester, a pick and slide de-nester, a pick and place de-nester, and/or a robotic solution configured to complete a non-traditional de-nesting process. In an embodiment the de-nesting system may utilize vacuum picking technology. Vacuum picking technology utilizes the differences in pressure between atmospheric pressure and the vacuum applied over the contact area, providing lifting force. This may allow a lid to be lifted and placed in a designated area.

With further reference to FIG. 1, method 100 may further include the formation of a lid, wherein the formation of a lid includes receiving lid material, shaping the lid material, and removing the shaped lid material to a secondary packaging process. Lid material may include foils made from aluminum, plastic, and/or paper in combination with a heat-activated lacquer coating, plastic layer, and/or polymers. For example, and without limitation lids may include paper-laminated aluminum and plastic film, aluminum with a heat-activated lacquer coating or heat-activated polymer layer, and/or multi-layer plastic such as polyester. In some cases, shaping the lid material may occur through roll stock lidding and/or die-cut lidding. Roll stock lidding is composed of reoccurring rows of lids that form a web structure, manufactured on roll stock of varying widths to accommodate differing numbers of lids per row. The large industrial-sized rolls may be slit, printed, and rolled into more manageable sizes for automated food processing equipment. These smaller more manageable rolls may be used directly on packaging machinery and/or pre-cut into single die-cut lids. "Die-cutting," as used in this disclosure, refers to the process in which a machine is used to mass-produce cut-out shapes. Die-cutting allows for the creation of the same shape, with the exact same dimensions, saving both time and creating uniformity. In an embodiment, the lids may be die-cut into a specific shape with specific dimensions. The coatings, such as adhesives and/or polymer layers may be applied to the entire surface and or precisely placed in a ring along the lid. The latter configuration may allow for less waste. The process of printing or stamping information, such as one's logo and/or other important information on the lid may occur prior to and/or after the shaping process. Additionally, rather than printing or stamping another embodiment may include placing a sticker on the surface of the lid. Printing, stamping, and/or stickering may occur in a separate process and/or as a continuation of method 100. These processes may occur on any manufacturing device as described within and/or manually where appropriate.

Further referencing FIG. 1, method 100 includes aligning and placing the lid flush against the rim of the container body 112. This process may occur as a continuation of the de-nesting process as discussed above. Alternatively, in some embodiments this may be accomplished manually. "Flush," as used in this disclosure, is having direct contact with, or being contiguous with. In some embodiments, the precise placement of lids may be accomplished by a pick and place machine. A pick and place machine automates and speeds up the process of picking up parts or items and placing them in other locations. Alignment of the lid and the container body 120 may be assisted by any manufacturing device as described throughout this disclosure. Additionally, alignment of the lid to the container body 120 may be dependent on previous steps of method 100. In an embodiment where the lid includes a polymer coating the annular portion of the coating may be a different thickness from the rest of the polymer coating. The thicker portion of the polymer coating may be aligned with the rim and then sealed in accordance with method 100. In an embodiment, alignment of the lid and the container body 120 may include singulation of one or more container bodies, which are then indexed via a linear and/or rotary intermittent-motion machine. Once an index has stopped, container body may be precisely below the pick and place device position. This may enable precision placement of a lid onto the rim of a container body. "Indexing," as used throughout this disclosure, is a technique that assists in a manufacturing process through precision placement. This process may involve rotating the workpiece and/or the cutter to a specific angular position, allowing for the precise placement, cutting of slots, grooves, and/or features at desired intervals. In a nonlimiting exemplary embodiment, alignment and placement of the lid 112 may include removing one or more lids from a magazine and/or die-cut from a roll stock and placed singularly onto the scaling surface, flange, or rim of the container body. In certain embodiments, this sealing surface may be recessed which may aid in alignment and provide protection to the seal. The alignment and placement of one or more lids 112 may be accomplished using a high-precision high-speed pick and place mechanism.

With continued reference to FIG. 1, method 100 includes sealing the lid to container body 116. Sealing the lid to the container body 116 may include applying heat to the container body components, including the rim of the body and the lid 120 and applying pressure to the lid 124. An airtight lid may be configured to prevent the contents of a container body from interacting with the atmosphere exterior to the interior of the cavity. In some cases, the airtight lid may provide for an airtight seal between the contents of the container body and the surrounding atmosphere. In some cases, airtight lid may include aluminum, plastic and/or any combination thereof. Further, an airtight lid may include a pull tab wherein a user may grip onto the pull tab in order to remove airtight lid. With the frangible seal created during the process of sealing the lid to the container body, the lid may be easily peeled from the container body. In some cases, one or more lids may be received from a bulk supply of precisely cut lids. Sealing the lid to the container body 116 may additionally include the singulation and precision placement of individual lids onto the top flange or surface of each container body. The dimensions and material composition of the lid may be specific to the orientation and material of the other segments of the container body, such as without limitation the opening having a rim, the body wall, and/or the like. The lid material may enable a hermetic seal capable of surviving high altitude distribution as well as allowing easy removal, for example by peeling the lid from the container body by the consumer after using the container for its intended purpose. As used in this disclosure, "hermetic" is a complete and airtight lid. The lid material may be a specified combination of a metallic material, and polymeric coatings and/or laminates on the interior or scaling surface. In an embodiment, there may further be an exterior portion to the lid configured to display print of some sort. The lid may be sealed/welded/adhered to the aluminum pod using one of several potential technologies. This may include technology that initiates induction scaling and/or heat sealing. For example, and without limitation, convection heat sealing, ultrasonic welding, and/or adhesive scaling. Embodiments may use exacting specifications for time, temperature, and pressure. In some cases, sealing the lid 116 may include hermetically scaling, welding, adhering and the like. For example, in an embodiment with an aluminum beverage pod the scaling conditions may include the use of convection heat sealing methods, including a temperature range of 240 to 350 degrees Celsius, a dwell time range of 0.4 s to 2.0 s, and contact pressure of ~1200 N/m2.

With further reference to FIG. 1, method 100 includes removing the sealed container body and lid to a secondary packaging process 128. Secondary packaging may include sleeves, boxes, and/or similar containers. Secondary packaging may include cutouts designed to hold individual container bodies in place and/or partitioned sliders positioned to include one or more container bodies. Secondary packaging may include additional forms of packaging to further secure beverage pods, such as without limitation, plastic shrink-wrap. The exterior of secondary packaging may include surfaces containing images and/or text marketing the contents and brand of the beverage pods placed within. Secondary packaging may further be placed into larger boxes to increase efficiency and storage for transit. Methods and/or operations of packaging of one or more sealed container bodies and lids in secondary packaging may include additional steps of singulation and precise positioning. These processes may occur manually and/or automatically. The final step of method 100 includes removing the sealed container body and lid to a secondary packaging process s128.

Manufacturing and/or forming of a part, workpiece, or other object may be performed, without limitation, using a manufacturing device. A manufacturing device may include an additive manufacturing devices may include without limitation any device designed or configured to produce a component, product, or the like using an additive manufacturing process, in which material is deposited on the workpiece to be turned into the finished result. In some embodiments, an additive manufacturing process is a process in which material is added incrementally to a body of material in a series of two or more successive steps. The material may be added in the form of a stack of incremental layers; each layer may represent a cross-section of the object to be formed upon completion of the additive manufacturing process. Each cross-section may, as a non-limiting example be modeled on a computing device as a cross-section of graphical representation of the object to be formed; for instance, a computer aided design (CAD) tool may be used to receive or generate a three-dimensional model of the object to be formed, and a computerized process may derive from that model a series of cross-sectional layers that, when deposited during the additive manufacturing process, together will form the object. The steps performed by an additive manufacturing system to deposit each layer may be guided by a computer aided manufacturing (CAM) tool. In other embodiments, a series of layers are deposited in a substantially radial form, for instance by adding a succession of coatings to the workpiece. Similarly, the material may be added in volumetric increments other than layers, such as by depositing physical voxels in rectilinear or other forms. Additive manufacturing, as used in this disclosure, may specifically include manufacturing done at the atomic and nano level. Additive manufacturing also includes bodies of material that are a hybrid of other types of manufacturing processes, e.g. forging and additive manufacturing as described above. As an example, a forged body of material may have welded material deposited upon it which then comprises an additive manufactured body of material.

Deposition of material in additive manufacturing processes may be accomplished by any suitable means. Deposition may be accomplished using stereolithography, in which successive layers of polymer material are deposited and then caused to bind with previous layers using a curing process such as curing using ultraviolet light. Additive manufacturing processes may include "three-dimensional printing" processes that deposit successive layers of power and binder; the powder may include polymer or ceramic powder, and the binder may cause the powder to adhere, fuse, or otherwise join into a layer of material making up the body of material or product. Additive manufacturing may include metal three-dimensional printing techniques such as laser sintering including direct metal laser sintering (DMLS) or laser powder-bed fusion. Likewise, additive manufacturing may be accomplished by immersion in a solution that deposits layers of material on the body of material, by depositing and sintering materials having melting points such as metals, such as selective laser sintering, by applying fluid or paste-like materials in strips or sheets and then curing that material either by cooling, ultraviolet curing, and the like, any combination of the above methods, or any additional methods that involve depositing successive layers or other increments of material. Methods of additive manufacturing may include without limitation vat polymerization, material jetting, binder jetting, material extrusion, fuse deposition modeling, powder bed fusion, sheet lamination, and directed energy deposition. Methods of additive manufacturing may include adding material in increments of individual atoms, molecules, or other particles. An additive manufacturing process may use a single method of additive manufacturing and/or combine two or more methods.

Additive manufacturing may include deposition of initial layers on a substrate. Substrate may include, without limitation, a support surface of an additive manufacturing device, or a removable item placed thereon. Substrate may include a base plate, which may be constructed of any suitable material; in some embodiments, where metal additive manufacturing is used, base plate may be constructed of metal, such as titanium. Base plate may be removable. One or more support features may also be used to support additively manufactured body of material during additive manufacture; for instance, and without limitation, where a downward-facing surface of additively manufactured body of material is constructed having less than a threshold angle of steepness, support structures may be necessary to support the downward-facing surface; threshold angle may be, for instance 45 degrees. Support structures may be additively constructed and may be supported on support surface and/or on upward-facing surfaces of additively manufactured body of material. Support structures may have any suitable form, including struts, buttresses, mesh, honeycomb or the like; persons skilled in the art, upon reviewing the entirety of this disclosure, will be aware of various forms that support structures may take consistently with the described methods and systems.

An additive manufacturing device may include an applicator or other additive device. For instance, an additive manufacturing device may include a printer head for a 3D printer. An additive manufacturing device may include an extruding device for extruding fluid or paste material, a sprayer or other applicator for bonding material, an applicator for powering, a sintering device such as a laser, or other such material.

An additive manufacturing device may include one or more robotic elements, including without limitation robot arms for moving, rotating, or otherwise positioning a workpiece, or for positioning a manufacturing tool, printer heads, or the like to work on workpiece. An additive manufacturing device may include one or more workpiece transport elements for moving a workpiece or finished part or component from one manufacturing stage to another; workpiece transport elements may include conveyors such as screw conveyors or conveyor belts, hoppers, rollers, or other items for moving an object from one place to another.

Manufacturing device may include a subtractive manufacturing device, which may perform one or more subtractive manufacturing processes. One or more steps may include a subtractive manufacturing process, which produces the product by removing material from a workpiece; the removal of material may be accomplished using abrasives, cutting tools or endmills, laser cutting or ablation, removal using heat, or any other method that removes material from the workpiece. Each subtractive manufacturing process used may be any suitable process, such as, but not limited to, rotary-tool milling, electronic discharge machining, ablation, etching, erosion, cutting, sawing, sanding, polishing, grinding, and cleaving, among others.

If rotary-tool milling is utilized, this milling may be accomplished using any suitable type of milling equipment, such as milling equipment having either a vertically or horizontally oriented spindle shaft. Examples of milling equipment include bed mills, turret mills, C-frame mills, floor mills, gantry mills, knee mills, and ram-type mills, among others. In some embodiments, the milling equipment used for removing material may be of the computerized numerical control (CNC) type that is automated and operates by precisely programmed commands that control movement of one or more parts of the equipment to affect the material removal. CNC machines, their operation, programming, and relation to CAM tools and CAD tools are well known and need not be described in detail herein for those skilled in the art to understand the scope of the present invention and how to practice it in any of its widely varying forms.

Subtractive manufacturing may be performed using spark-erosive devices; for instance, subtractive manufacturing may include removal of material using electronic discharge machining (EDM). EDM may include wire EDM, plunge EDM, immersive EDM, ram EDM, or any other EDM manufacturing technique. Subtractive manufacturing may be performed using laser-cutting processes. Subtractive manufacturing may be performed using water-jet or other fluid-jet cutting techniques. Fundamentally, any process for removal of material may be employed for subtractive manufacturing.

Manufacturing device may include a mechanical manufacturing device. In an embodiment, mechanical manufacturing device may be a manufacturing device that deprives the user of some direct control over the toolpath, defined as movements the manufacturing tool and workpiece make relative to one another during the one or more manufacturing steps. For instance, manufacturing tool may be constrained to move vertically, by a linear slide or similar device, so that the only decision the user may make is to raise or lower the manufacturing tool; as a non-limiting example, where manufacturing device is a manually operated machine tool, user may only be able to raise and lower a cutting tool, and have no ability to move the cutting tool horizontally. Similarly, where manufacturing tool includes a slide lathe, a blade on the slide lathe may be constrained to follow a particular path. As a further example, base table may be moveable along one or more linear axes; for instance, base table may be constrained to move along a single horizontal axis. In other embodiments, base table is constrained to movement along two horizontal axes that span two dimensions, permitting freedom of movement only in a horizontal plane; for instance, base table may be mounted on two mutually orthogonal linear slides.

Manufacturing device may include a powered manufacturing device. In an embodiment, a powered manufacturing device may be a manufacturing device in which at least one component of the manufacturing device includes at least a component powered by something other than human power. At least a component may be powered by any non-human source, including without limitation electric power generated or stored by any means, heat engines including steam, internal combustion, or diesel engines, wind power, waterpower, pneumatic power, or hydraulic power. Powered components may include any components of manufacturing device. Manufacturing tool may be powered; for instance, manufacturing tool may include an endmill mounted on a spindle rotated by a motor (not shown). Workpiece support may be powered. Where manufacturing device is a mechanical device, motion of components along linear or rotary constraints may be powered; for instance, motion of base table along one or more linear constraints such as linear slides may be driven by a motor or other source of power. Similarly, rotation of a table may be driven by a power source. Tool-changers, where present, may be driven by power. In some embodiments, all or substantially all of the components of manufacturing device are powered by something other than human power; for instance, all components may be powered by electrical power.

Manufacturing device may include an automated manufacturing system. In some embodiments, an automated manufacturing system is a manufacturing device including a controller that controls one or more manufacturing steps automatically. Controller may include a sequential control device that produces a sequence of commands without feedback from other components of automated manufacturing system. Controller may include a feedback control device that produces commands triggered or modified by feedback from other components. Controller may perform both sequential and feedback control. In some embodiments, controller includes a mechanical device. In other embodiments, controller includes an electronic device. Electronic device may include digital or analog electronic components, including without limitation one or more logic circuits, such one or more logic gates, programmable elements such as field-programmable arrays, multiplexors, one or more operational amplifiers, one or more diodes, one or more transistors, one or more comparators, and one or more integrators. Electronic device may include a processor. Electronic device may include a computing device. Computing device may include any computing device as described below. Computing device may include a computing device embedded in manufacturing device; as a non-limiting example, computing device may include a microcontroller, which may be housed in a unit that combines the other components of manufacturing device. Controller may include a manufacturer client of plurality of manufacturer clients; controller may be communicatively coupled to a manufacturer client of plurality of manufacturer clients.

Controller may include a component embedded in manufacturing device; as a non-limiting example, controller may include a microcontroller, which may be housed in a unit that combines the other components of manufacturing device. Further continuing the example, microcontroller may have program memory, which may enable microcontroller to load a program that directs manufacturing device to perform an automated manufacturing process. Similarly, controller may include any other components of a computing device as described below in a device housed within manufacturing device. In other embodiments, controller includes a computing device that is separate from the rest of the components of manufacturing device; for instance, controller may include a personal computer, laptop, or workstation connected to the remainder of manufacturing device by a wired or wireless data connection. In some embodiments, controller includes both a personal computing device where a user may enter instructions to generate a program for turning workpiece into a finished product, and an embedded device that receives the program from the personal computing device and executes the program. Persons skilled in the art will be aware of various ways that a controller, which may include one or more computing devices, may be connected to or incorporated in an automated manufacturing system as described above.

Controller may control components of automated manufacturing system; for instance, controller may control elements including without limitation tool changer to switch endmills, spindle or gear systems operatively coupled to spindle to regulate spindle rotational speed, linear movement of manufacturing tool, base table, or both, and rotation or rotational position of rotary table. As an example, controller may coordinate deposition and/or curing of material in additive manufacturing processes, where manufacturing device is an additive manufacturing device. Persons skilled in the art, upon reading the entirety of this disclosure, will be aware of similar automated control systems usable for various forms manufacturing.

Controller may be designed and/or configured to perform any method, method step, or sequence of method steps in any embodiment described in this disclosure, in any order and with any degree of repetition. For instance, controller may be configured to perform a single step or sequence repeatedly until a desired or commanded outcome is achieved; repetition of a step or a sequence of steps may be performed iteratively and/or recursively using outputs of previous repetitions as inputs to subsequent repetitions, aggregating inputs and/or outputs of repetitions to produce an aggregate result, reduction or decrement of one or more variables such as global variables, and/or division of a larger processing task into a set of iteratively addressed smaller processing tasks. Controller may perform any step or sequence of steps as described in this disclosure in parallel, such as simultaneously and/or substantially simultaneously performing a step two or more times using two or more parallel threads, processor cores, or the like; division of tasks between parallel threads and/or processes may be performed according to any protocol suitable for division of tasks between iterations. Persons skilled in the art, upon reviewing the entirety of this disclosure, will be aware of various ways in which steps, sequences of steps, processing tasks, and/or data may be subdivided, shared, or otherwise dealt with using iteration, recursion, and/or parallel processing.

An object, part, and/or workpiece may be further processed as desired to finish that object, part, and/or workpieces. Examples of further process include but are not limited to: secondary machining, polishing, coating such as powder coating, anodization, silk-screening, and any combination thereof, among others. Fundamentally, there is no limitation on the finishing steps, if any, that may occur for a finishing step.

Continuing to reference FIG. 1, system and method of manufacture 100 may include a computing device. Computing device includes a processor communicatively connected to a memory. As used in this disclosure, "communicatively connected" means connected by way of a connection, attachment or linkage between two or more relata which allows for reception and/or transmittance of information therebetween. For example, and without limitation, this connection may be wired or wireless, direct or indirect, and between two or more components, circuits, devices, systems, and the like, which allows for reception and/or transmittance of data and/or signal(s) therebetween. Data and/or signals therebetween may include, without limitation, electrical, electromagnetic, magnetic, video, audio, radio and microwave data and/or signals, combinations thereof, and the like, among others. A communicative connection may be achieved, for example and without limitation, through wired or wireless electronic, digital or analog, communication, either directly or by way of one or more intervening devices or components. Further, communicative connection may include electrically coupling or connecting at least an output of one device, component, or circuit to at least an input of another device, component, or circuit. For example, and without limitation, via a bus or other facility for intercommunication between elements of a computing device. Communicative connecting may also include indirect connections via, for example and without limitation, wireless connection, radio communication, low power wide area network, optical communication, magnetic, capacitive, or optical coupling, and the like. In some instances, the terminology "communicatively coupled" may be used in place of communicatively connected in this disclosure.

Further referring to FIG. 1, Computing device may include any computing device as described in this disclosure, including without limitation a microcontroller, microprocessor, digital signal processor (DSP) and/or system on a chip (SoC) as described in this disclosure. Computing device may include, be included in, and/or communicate with a mobile device such as a mobile telephone or smartphone. Computing device may include a single computing device operating independently, or may include two or more computing device operating in concert, in parallel, sequentially or the like; two or more computing devices may be included together in a single computing device or in two or more computing devices. Computing device may interface or communicate with one or more additional devices as described below in further detail via a network interface device. Network interface device may be utilized for connecting computing device to one or more of a variety of networks, and one or more devices. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network may employ a wired and/or a wireless mode of communication. In general, any network topology may be used. Information (e.g., data, software etc.) may be communicated to and/or from a computer and/or a computing device. Computing device may include but is not limited to, for example, a computing device or cluster of computing devices in a first location and a second computing device or cluster of computing devices in a second location. Computing device may include one or more computing devices dedicated to data storage, security, distribution of traffic for load balancing, and the like. Computing device may distribute one or more computing tasks as described below across a plurality of computing devices of computing device, which may operate in parallel, in series, redundantly, or in any other manner used for distribution of tasks or memory between computing devices. Computing device may be implemented, as a non-limiting example, using a "shared nothing" architecture.

With continued reference to FIG. 1, computing device may be designed and/or configured to perform any method, method step, or sequence of method steps in any embodiment described in this disclosure, in any order and with any degree of repetition. For instance, computing device may be configured to perform a single step or sequence repeatedly until a desired or commanded outcome is achieved; repetition of a step or a sequence of steps may be performed iteratively and/or recursively using outputs of previous repetitions as inputs to subsequent repetitions, aggregating inputs and/or outputs of repetitions to produce an aggregate result, reduction or decrement of one or more variables such as global variables, and/or division of a larger processing task into a set of iteratively addressed smaller processing tasks. Computing device may perform any step or sequence of steps as described in this disclosure in parallel, such as simultaneously and/or substantially simultaneously performing a step two or more times using two or more parallel threads, processor cores, or the like; division of tasks between parallel threads and/or processes may be performed according to any protocol suitable for division of tasks between iterations. Persons skilled in the art, upon reviewing the entirety of this disclosure, will be aware of various ways in which steps, sequences of steps, processing tasks, and/or data may be subdivided, shared, or otherwise dealt with using iteration, recursion, and/or parallel processing.

Figure 2:
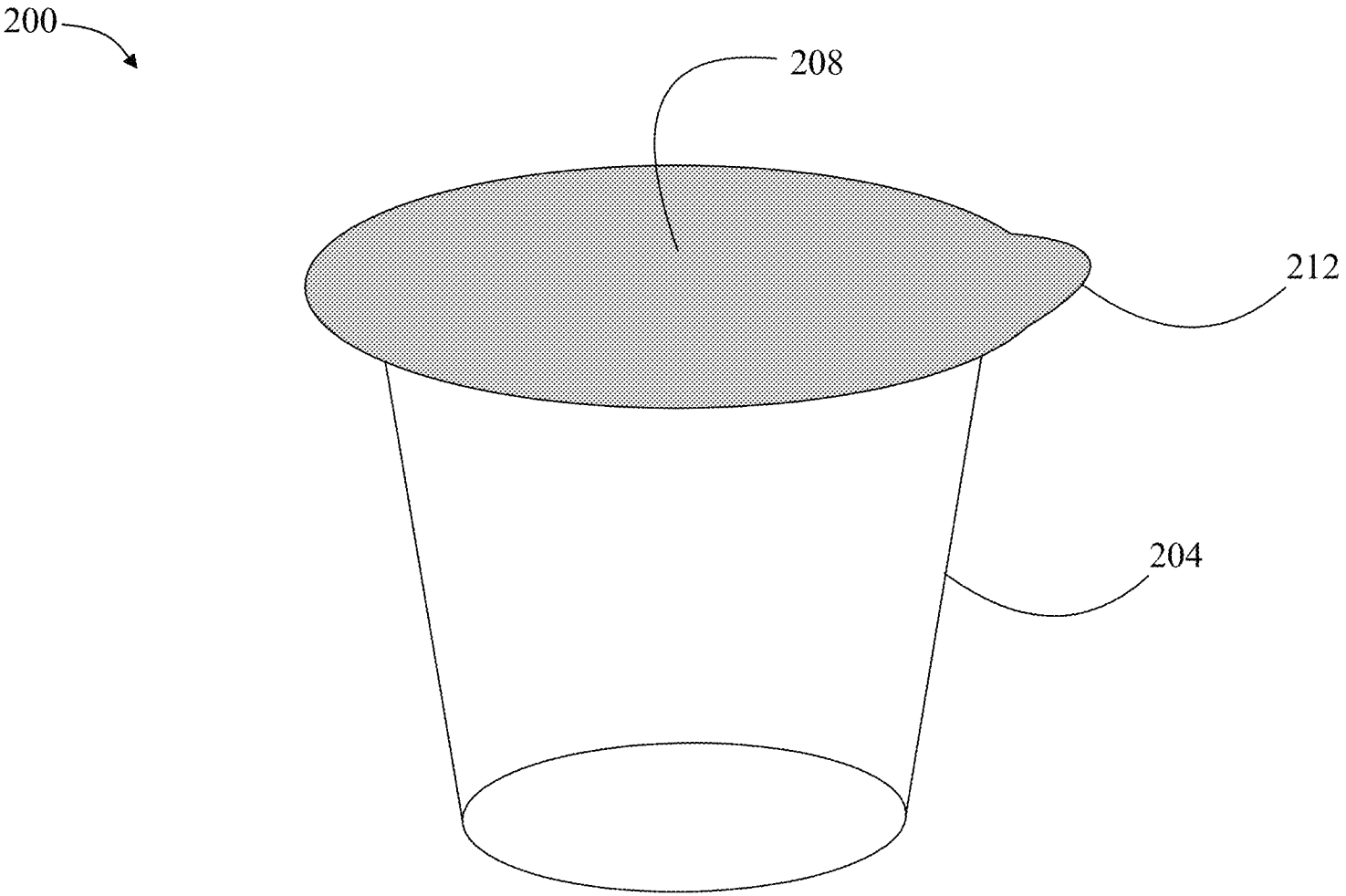
FIG. 2 illustrates a particular embodiment of a container with a peelable lid having a frangible seal.

Now referring to FIG. 2, a nonlimiting particular embodiment of a peelable lid with a frangible seal is shown. A peelable lid with a frangible seal may include container body 204, lid 208, and pull tab 212. These components may include any embodiments discussed throughout this disclosure and any disclosure here within incorporated by reference.

Figure 3:
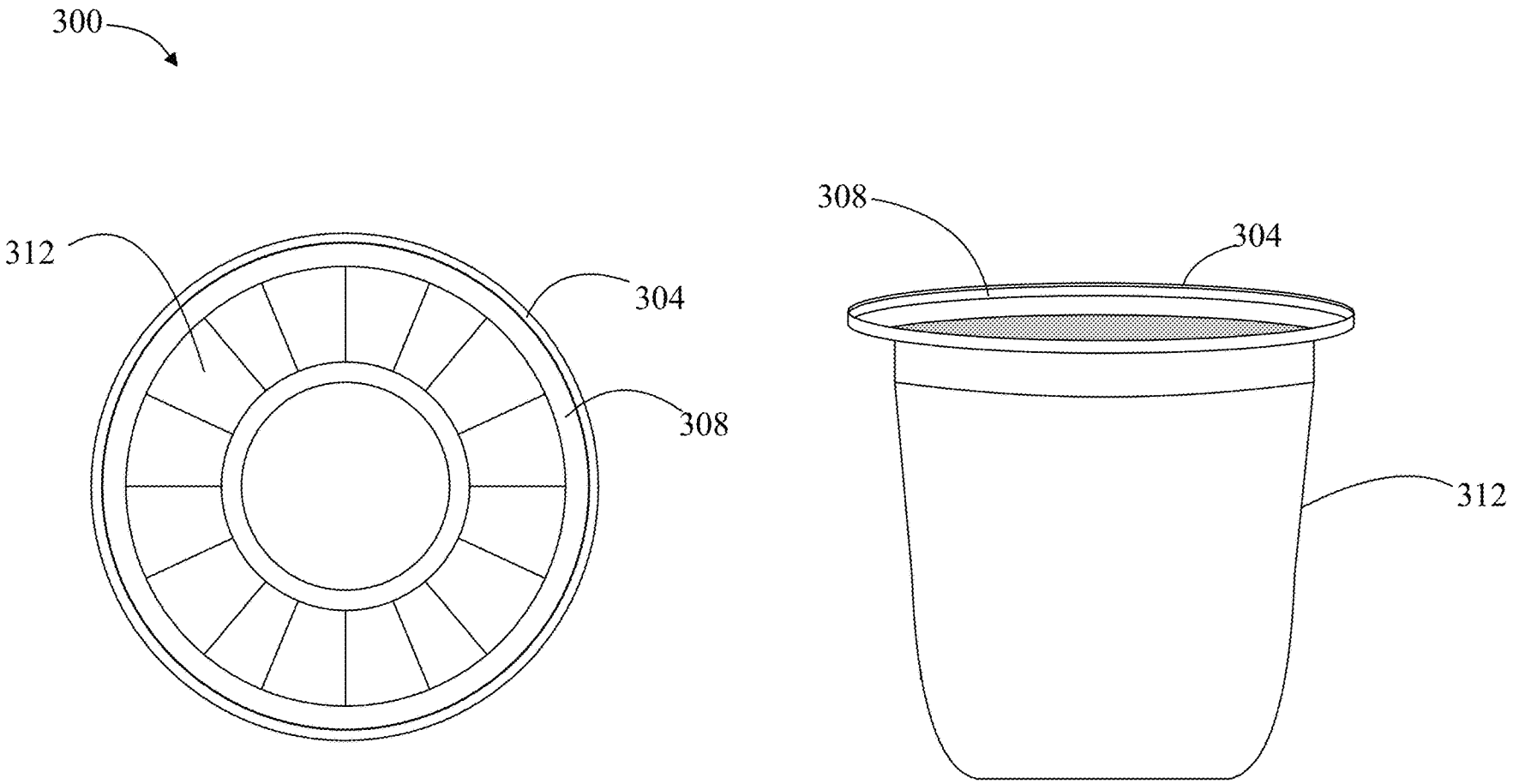
FIG. 3 illustrates a particular embodiment of a container body.

Now referring to FIG. 3, a particular embodiment of a container body is shown. Illustrated is a top-down view aside a side profile view of the particular embodiment of a container body. In this particular embodiment the rim of a container body may include more than a single rim. As pictured in the particular implementation a first, smaller rim 304 is situated in a way that protects the second, larger in width rim 308. Note, how this particular implementation may provide a safe guard to the frangible seal by having a first raised rim 304 that is configured to protect the second rim 308 which is recessed on the vertical plane from the first rim 304. Depicted for case of viewing is wall of container body 112. In some embodiments, wherein a polymer layer and/or an adhesive is used on the rim of the container body, second rim 308 may be the area where this is applied.

Figure 4A:
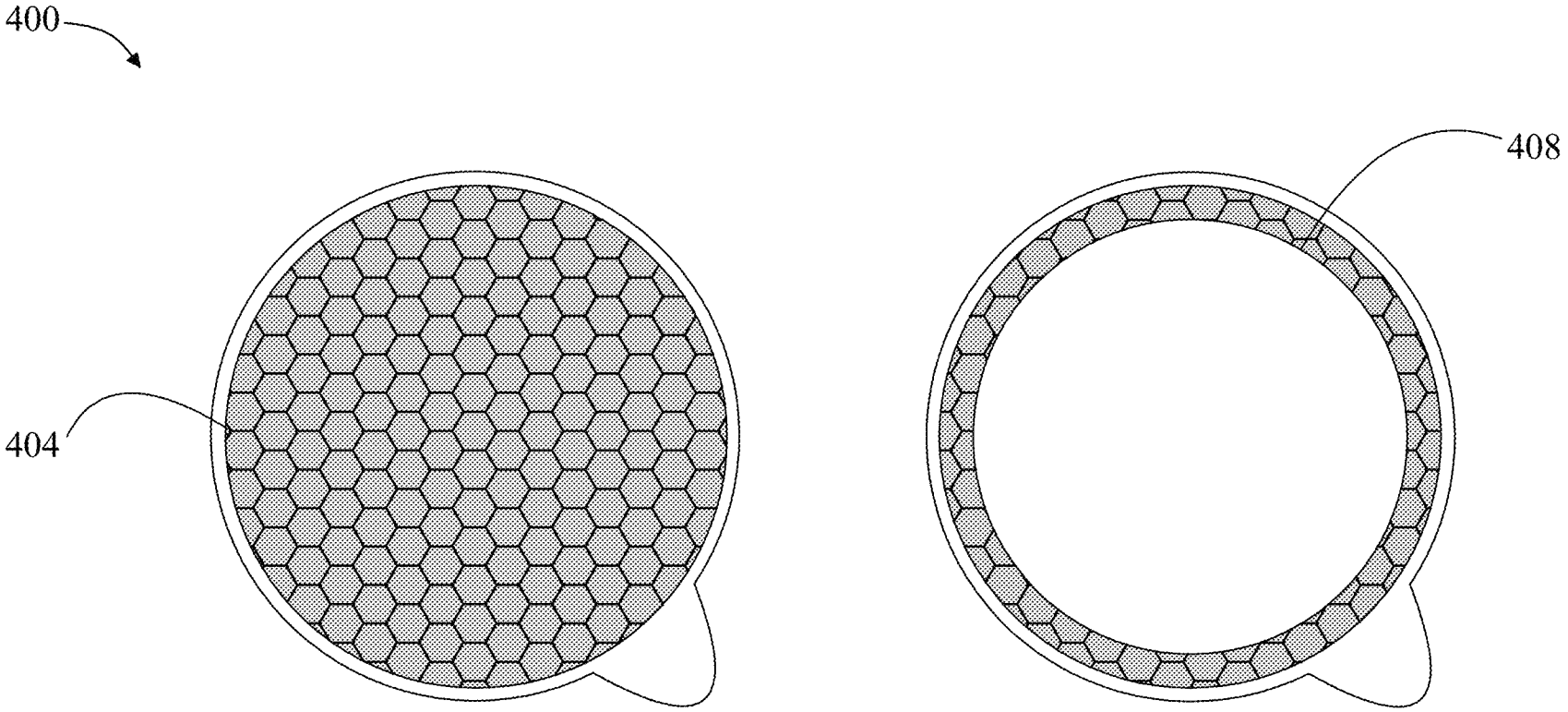
FIG. 4A illustrates particular embodiments of adhesive/polymer layer placement on a lid.
Figure 4B:
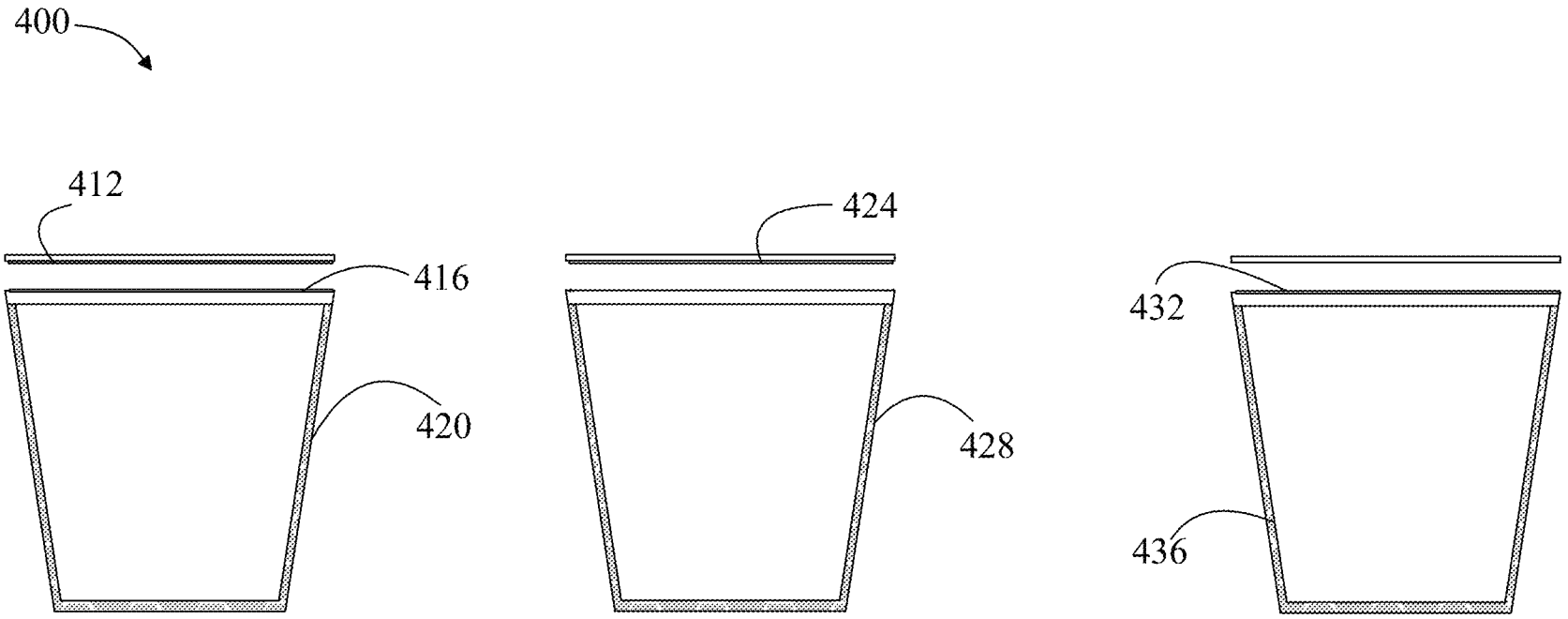
FIG. 4B illustrates particular embodiments of adhesive/polymer thickness in relation to the container body wall, rim, and lid.

Now referring to FIGS. 4A and 4B, particular embodiments and placement of adhesives and/or polymer layers are illustrated. In a nonlimiting embodiment, adhesive/polymer layer 404 covers the entirety of the underlying lid. Other embodiments may have no surrounding edge and/or a larger surrounding edge as pictured in FIG. 4A. Furthermore, some embodiments, such as the adhesive/polymer layer 408 may create a pattern that coincides with the shape and/or dimension of the corresponding rim of the container body. This may include an embodiment as pictured and/or any embodiment as described throughout this disclosure. For example, and without limitation, the underside of the lid may include no additional adhesive and/or polymer layer. Layer meaning either lining and/or coating depending on the application thereof. Polymer layers may be in different thicknesses across any embodiment of the lid and/or rim. In reference to FIG. 4B, further exemplary embodiments may include a lid with an underside having a polymer layer having a different thickness in comparison to the thickness of the rim and/or interior body wall. These embodiments and configurations are nonlimiting and may be substituted with any description as used throughout this disclosure. Additionally, thicknesses are shown not necessarily to scale, but to visually depict the difference between the thicknesses. Lid polymer layer 412 is shown in combination with rim polymer layer 416 and container body wall polymer layer 420. In some embodiments, there may be a thicker lid polymer layer 424 in comparison to the lid polymer layer and the container body wall polymer layer 428. Further, in some embodiments, the rim polymer layer 432 may be thicker than the lid polymer layer and the container body polymer layer 436. In some embodiments container body wall polymer layer may be thicker than both the lid polymer layer and/or the rim polymer layer. This may be so, in part, because of the purpose of each layer. Because the frangible seal depends on the polymer layers of the lid and/or rim these layers may be thinner in comparison to the container body wall polymer layers.

Figure 5:
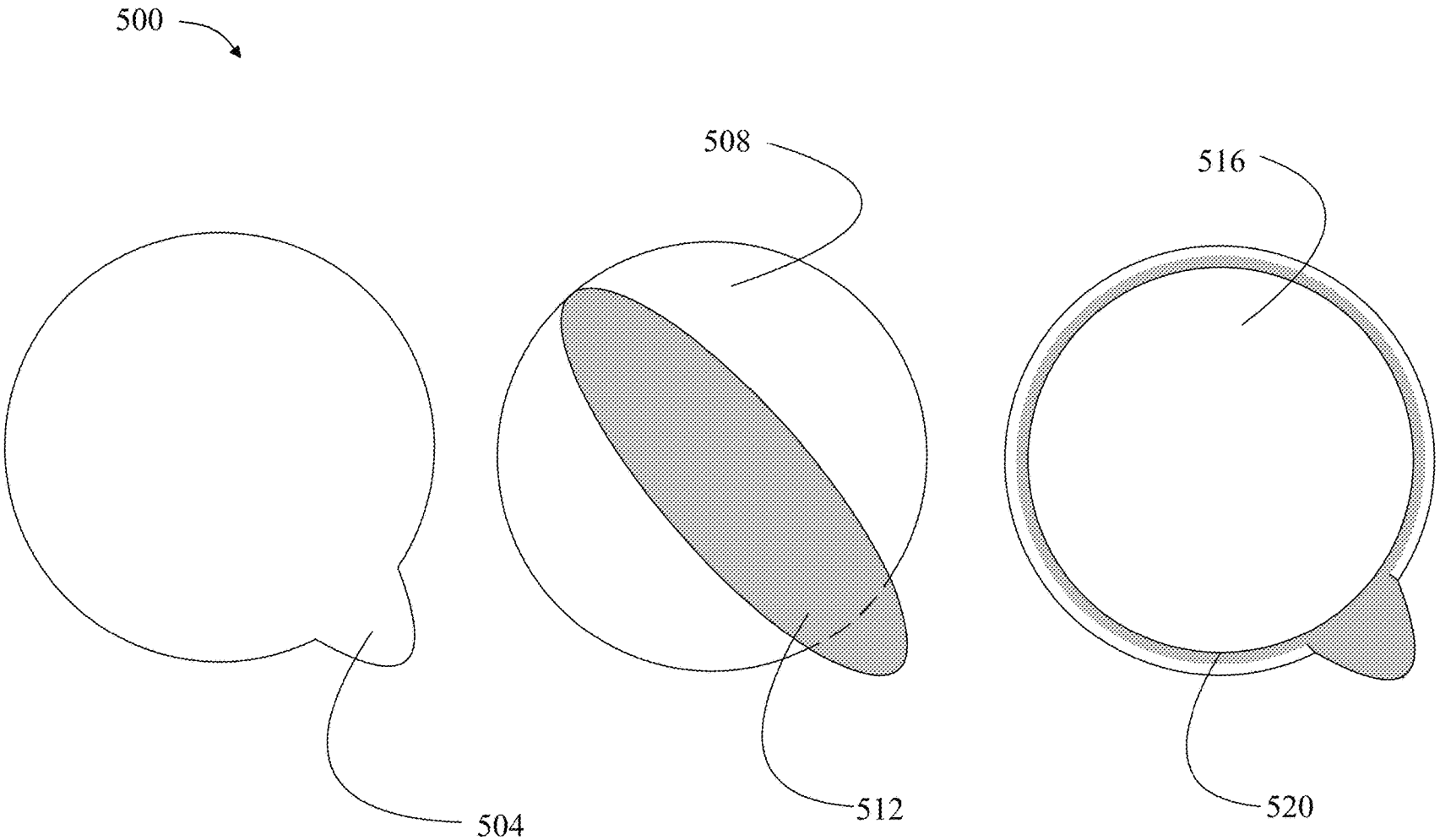
FIG. 5 illustrates particular embodiments of pull-tab structure and placement.

Now referring to FIG. 5, particular embodiments of a pull tab are illustrated. Pull tab 504 illustrates an embodiment wherein the pull tab is included in the embodiment of the lid. Alternatively, lid 508 illustrates pull tab 512, wherein the pull tab exists separately from lid 508. This configuration illustrates an embodiment where pull tab 512 extends across the length of lid 508. Lastly, lid 516 illustrates pull tab 520 which is configured in a pattern that may match up with a corresponding rim of a container body. These components may include any embodiments discussed throughout this disclosure and any disclosure here within incorporated by reference.

Figure 6:
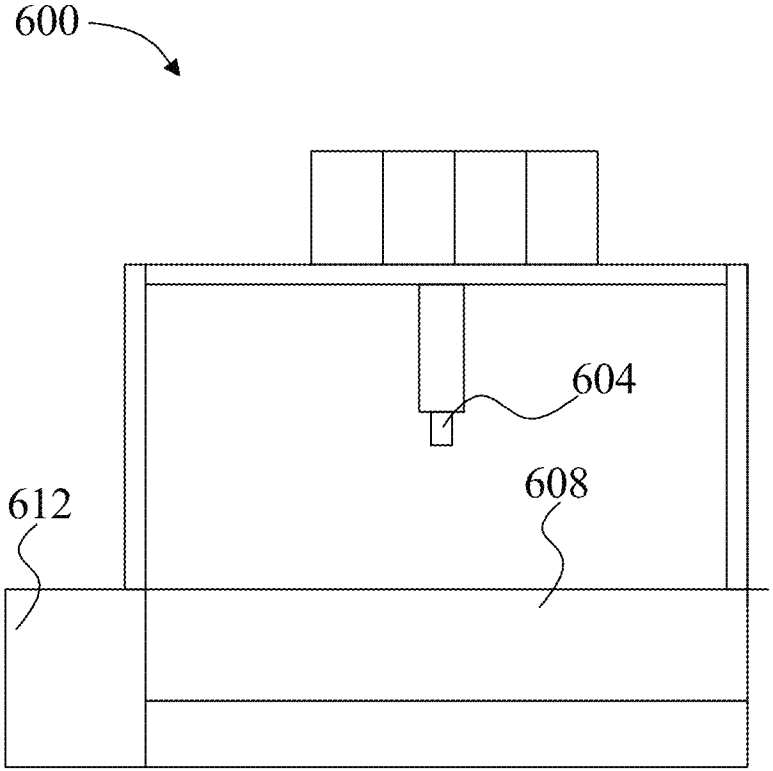
FIG. 6 illustrates a particular embodiment of a manufacturing device.

Referring now to FIG. 6, a block diagram of an exemplary embodiment of a manufacturing device 600 is illustrated. Manufacturing device 600 may include at least an applicator 604. At least an applicator 604 may include any device used to deposit layers of ingredient and/or material. For instance, applicator 604 may include a printer head for a 3D printer. Applicator 604 may include an extruding device for extruding fluid and/or paste material, a sprayer or other applicator for bonding material, an applicator for powering, a sintering device such as a laser, or other such material. Applicator 604 may draw upon one or more reservoirs of liquid, paste, and/or powdered materials, which may advance such materials to application using, without limitation, auger screws, pistons, gravity, and/or pressure. Applicator 604 may additionally, in some embodiments include a head for stamping.

Continuing to view FIG. 6, manufacturing device 600 may include workpiece support 608. Workpiece support 608 may be a structure that supports a workpiece during one or more manufacturing steps. Workpiece support 608 may include a base table. The base table may further include a surface to which a workpiece and/or other components may be secured. The surface may be oriented horizontally, vertically, and/or in any other orientation suited for the embodiment and configuration of a given manufacturing process. The surface may be substantially planar. Workpiece support 608 may include a substrate for initial deposition of material in an additive process.

Still referring to FIG. 6, manufacturing device 600 may include a powered additive manufacturing device. As used herein, a powered additive manufacturing device is an additive manufacturing device in which at least one component of the additive manufacturing device includes at least a component powered by something other than human power. At least a component may be powered by any non-human source, including without limitation electric power generated or stored by any means, heat engines including steam, internal combustion, or diesel engines, wind power, waterpower, pneumatic power, or hydraulic power. Powered components may include any component of additive manufacturing device. Applicator 604 may be powered; for instance, applicator 604 may include an endmill mounted on a spindle rotated by a motor (not shown). Workpiece support 608 may be powered. Where manufacturing device 600 is a mechanical device, motion of components along linear or rotary constraints may be powered; for instance, motion of base table along one or more linear constraints such as linear slides may be driven by a motor or other source of power. Similarly, rotation of rotary table may be driven by a power source. Tool-changers, where present, may be driven by power. In some embodiments, all or substantially all of the components of manufacturing device 600 may be powered by something other than human power; for instance, all components may be powered by electrical power.

Further referring to FIG. 6, manufacturing device 600 may include an automated manufacturing system. In some embodiments, an automated manufacturing system is a manufacturing device 600 including a controller 612 that controls one or more manufacturing steps automatically. Controller 612 may include a sequential control device that produces a sequence of commands without feedback from other components of automated manufacturing system. Controller 612 may include a feedback control device that produces commands triggered or modified by feedback from other components. Controller 612 may perform both sequential and feedback control. In some embodiments, controller 612 includes a mechanical device. In other embodiments, controller 612 includes an electronic device. Electronic device may include digital or analog electronic components, including without limitation one or more logic circuits, such one or more logic gates, programmable elements such as field-programmable arrays, multiplexors, one or more operational amplifiers, one or more diodes, one or more transistors, one or more comparators, and one or more integrators. Electronic device may include a processor. Electronic device may include a computing device 600 as described below in reference to FIG. 6. Computing device 600 may include a computing device 600 embedded in manufacturing device 600; as a non-limiting example, computing device 600 may include a microcontroller 612, which may be housed in a unit that combines the other components of manufacturing device 600. Controller 612 may include a manufacturer client of plurality of manufacturer clients; controller 612 may be communicatively coupled to a manufacturer client of plurality of manufacturer clients.

Continue referring to FIG. 6, controller 612 may include a component embedded in manufacturing device 600; as a non-limiting example, controller 612 may include a microcontroller 612, which may be housed in a unit that combines the other components of manufacturing device 600. Further continuing the example, microcontroller 612 may have program memory, which may enable microcontroller 612 to load a program that directs manufacturing device 600 to perform an automated manufacturing process. Similarly, controller 612 may include any other components of a computing device 700 as described below in reference to FIG. 6 in a device housed within manufacturing device 600. In other embodiments, controller 612 includes a computing device 700 that is separate from the rest of the components of manufacturing device 600; for instance, controller 612 may include a personal computer, laptop, or workstation connected to the remainder of additive manufacturing device 600 by a wired or wireless data connection. In some embodiments, controller 612 includes both a personal computing device 600 where a user may enter instructions to generate a program for turning workpiece into a finished product, and an embedded device that receives the program from the personal computing device 600 and executes the program. Persons skilled in the art will be aware of various ways that a controller 612, which may include one or more computing device, may be connected to, or incorporated in an automated manufacturing system as described above.

Still referring to FIG. 6, controller 612 may control components of automated manufacturing system; for instance, controller 612 may control elements including without limitation tool changer to switch endmills, spindle or gear systems operatively coupled to spindle to regulate spindle rotational speed, linear movement of applicator 604, base table, or both, and rotation or rotational position of rotary table. As an example, applicator 604 may be moved about using computerized numerical control (CNC) devices and/or motion controls that are automated and operate by precisely programmed commands that control movement of one or more parts of the equipment to affect the material removal. CNC machines, their operation, programming, and relation to computer aided manufacturing (CAM) tools and computer aided design (CAD) tools are well known and need not be described in detail herein for those skilled in the art to understand the scope of the present invention and how to practice it in any of its widely varying forms. Similarly, controller 612 may coordinate deposition and/or curing of material in additive manufacturing processes, where manufacturing device 600 is an additive manufacturing device. Persons skilled in the art, upon reading the entirety of this disclosure, will be aware of similar automated control systems usable for various forms manufacturing. Controller may be, be included in, include, and/or be in communication with computing device 700.

Further referencing on FIG. 6, in operation, the manufacturing device 600 may deposit layers of edible material or ingredient, including without limitation powdered supplements and/or substrates, as programmed by computing device 600 and/or controller 612.

It is to be noted that any one or more of the aspects and embodiments described herein may be conveniently implemented using one or more machines (e.g., one or more computing devices that are utilized as a user computing device for an electronic document, one or more server devices, such as a document server, etc.) programmed according to the teachings of the present specification, as will be apparent to those of ordinary skill in the computer art. Appropriate software coding can readily be prepared by skilled programmers based on the teachings of the present disclosure, as will be apparent to those of ordinary skill in the software art. Aspects and implementations discussed above employing software and/or software modules may also include appropriate hardware for assisting in the implementation of the machine executable instructions of the software and/or software module.

Such software may be a computer program product that employs a machine-readable storage medium. A machine-readable storage medium may be any medium that is capable of storing and/or encoding a sequence of instructions for execution by a machine (e.g., a computing device) and that causes the machine to perform any one of the methodologies and/or embodiments described herein. Examples of a machine-readable storage medium include, but are not limited to, a magnetic disk, an optical disc (e.g., CD, CD-R, DVD, DVD-R, etc.), a magneto-optical disk, a read-only memory "ROM" device, a random access memory "RAM" device, a magnetic card, an optical card, a solid-state memory device, an EPROM, an EEPROM, and any combinations thereof. A machine-readable medium, as used herein, is intended to include a single medium as well as a collection of physically separate media, such as, for example, a collection of compact discs or one or more hard disk drives in combination with a computer memory. As used herein, a machine-readable storage medium does not include transitory forms of signal transmission.

Such software may also include information (e.g., data) carried as a data signal on a data carrier, such as a carrier wave. For example, machine-executable information may be included as a data-carrying signal embodied in a data carrier in which the signal encodes a sequence of instruction, or portion thereof, for execution by a machine (e.g., a computing device) and any related information (e.g., data structures and data) that causes the machine to perform any one of the methodologies and/or embodiments described herein.

Examples of a computing device include, but are not limited to, an electronic book reading device, a computer workstation, a terminal computer, a server computer, a handheld device (e.g., a tablet computer, a smartphone, etc.), a web appliance, a network router, a network switch, a network bridge, any machine capable of executing a sequence of instructions that specify an action to be taken by that machine, and any combinations thereof. In one example, a computing device may include and/or be included in a kiosk.

Figure 7:
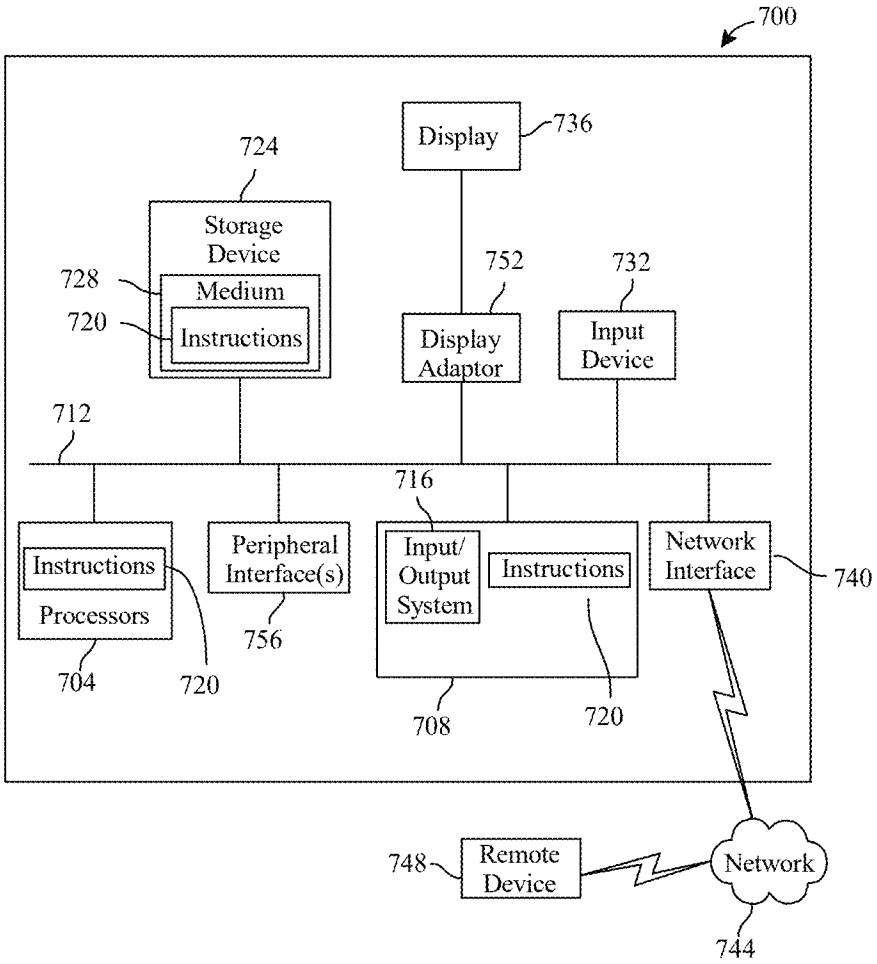
FIG. 7 is a block diagram of a computing system that can be used to implement any one or more of the methodologies disclosed herein and any one or more portions thereof.

FIG. 7 shows a diagrammatic representation of one embodiment of a computing device in the exemplary form of a computer system 700 within which a set of instructions for causing a control system to perform any one or more of the aspects and/or methodologies of the present disclosure may be executed. It is also contemplated that multiple computing devices may be utilized to implement a specially configured set of instructions for causing one or more of the devices to perform any one or more of the aspects and/or methodologies of the present disclosure. Computer system 700 includes a processor 704 and a memory 708 that communicate with each other, and with other components, via a bus 712. Bus 712 may include any of several types of bus structures including, but not limited to, a memory bus, a memory controller, a peripheral bus, a local bus, and any combinations thereof, using any of a variety of bus architectures.

Processor 704 may include any suitable processor, such as without limitation a processor incorporating logical circuitry for performing arithmetic and logical operations, such as an arithmetic and logic unit (ALU), which may be regulated with a state machine and directed by operational inputs from memory and/or sensors; processor 704 may be organized according to Von Neumann and/or Harvard architecture as a non-limiting example. Processor 704 may include, incorporate, and/or be incorporated in, without limitation, a microcontroller, microprocessor, digital signal processor (DSP), Field Programmable Gate Array (FPGA), Complex Programmable Logic Device (CPLD), Graphical Processing Unit (GPU), general purpose GPU, Tensor Processing Unit (TPU), analog or mixed signal processor, Trusted Platform Module (TPM), a floating point unit (FPU), system on module (SOM), and/or system on a chip (SoC).

Memory 708 may include various components (e.g., machine-readable media) including, but not limited to, a random-access memory component, a read only component, and any combinations thereof. In one example, a basic input/output system 716 (BIOS), including basic routines that help to transfer information between elements within computer system 700, such as during start-up, may be stored in memory 708. Memory 708 may also include (e.g., stored on one or more machine-readable media) instructions (e.g., software) 720 embodying any one or more of the aspects and/or methodologies of the present disclosure. In another example, memory 708 may further include any number of program modules including, but not limited to, an operating system, one or more application programs, other program modules, program data, and any combinations thereof.

Computer system 700 may also include a storage device 724. Examples of a storage device (e.g., storage device 724) include, but are not limited to, a hard disk drive, a magnetic disk drive, an optical disc drive in combination with an optical medium, a solid-state memory device, and any combinations thereof. Storage device 724 may be connected to bus 712 by an appropriate interface (not shown). Example interfaces include, but are not limited to, SCSI, advanced technology attachment (ATA), serial ATA, universal serial bus (USB), IEEE 1394 (FIREWIRE), and any combinations thereof. In one example, storage device 724 (or one or more components thereof) may be removably interfaced with computer system 700 (e.g., via an external port connector (not shown)). Particularly, storage device 724 and an associated machine-readable medium 728 may provide nonvolatile and/or volatile storage of machine-readable instructions, data structures, program modules, and/or other data for computer system 700. In one example, software 720 may reside, completely or partially, within machine-readable medium 728. In another example, software 720 may reside, completely or partially, within processor 704.

Computer system 700 may also include an input device 732. In one example, a user of computer system 700 may enter commands and/or other information into computer system 700 via input device 732. Examples of an input device 732 include, but are not limited to, an alpha-numeric input device (e.g., a keyboard), a pointing device, a joystick, a gamepad, an audio input device (e.g., a microphone, a voice response system, etc.), a cursor control device (e.g., a mouse), a touchpad, an optical scanner, a video capture device (e.g., a still camera, a video camera), a touchscreen, and any combinations thereof. Input device 732 may be interfaced to bus 712 via any of a variety of interfaces (not shown) including, but not limited to, a serial interface, a parallel interface, a game port, a USB interface, a FIREWIRE interface, a direct interface to bus 712, and any combinations thereof. Input device 732 may include a touch screen interface that may be a part of or separate from display 736, discussed further below. Input device 732 may be utilized as a user selection device for selecting one or more graphical representations in a graphical interface as described above.

A user may also input commands and/or other information to computer system 700 via storage device 724 (e.g., a removable disk drive, a flash drive, etc.) and/or network interface device 740. A network interface device, such as network interface device 740, may be utilized for connecting computer system 700 to one or more of a variety of networks, such as network 744, and one or more remote devices 748 connected thereto. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network, such as network 744, may employ a wired and/or a wireless mode of communication. In general, any network topology may be used. Information (e.g., data, software 720, etc.) may be communicated to and/or from computer system 700 via network interface device 740.

Computer system 700 may further include a video display adapter 762 for communicating a displayable image to a display device, such as display device 736. Examples of a display device include, but are not limited to, a liquid crystal display (LCD), a cathode ray tube (CRT), a plasma display, a light emitting diode (LED) display, and any combinations thereof. Display adapter 752 and display device 736 may be utilized in combination with processor 704 to provide graphical representations of aspects of the present disclosure. In addition to a display device, computer system 700 may include one or more other peripheral output devices including, but not limited to, an audio speaker, a printer, and any combinations thereof. Such peripheral output devices may be connected to bus 712 via a peripheral interface 756. Examples of a peripheral interface include, but are not limited to, a serial port, a USB connection, a FIREWIRE connection, a parallel connection, and any combinations thereof.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve methods, systems, and software according to the present disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A method of manufacture for a highly peelable lid with a frangible seal, wherein the method comprises:

providing a container body comprising an open end having rims with a polymer lining, wherein the rims comprise a first, smaller in width rim which is configured to protect a second, larger in width rim, a body wall, a cavity, and a closed end;

receiving a lid having a top side and an underside, wherein the underside further comprises a polymer coating having varying thickness on the underside of the lid;

attaching a pull tab, distinct from the lid, to the lid such that the pull tab extends, across the lid, from a first side of the lid to an opposed second side of the lid, wherein the pull tab is configured to sit flush with a wall of the container body;

aligning and placing the lid flush against the second larger in width rim of the container body; and sealing the lid to the container body, wherein sealing is comprised of:

applying heat comprising convection heat sealing to components of the container body, including the second larger in width rim of the body and the lid; and applying pressure to the lid.

2. The method of claim 1, wherein the container body is comprised of an aluminum material.

3. The method of claim 1, wherein the container body is comprised of an aluminum alloy material.

4. The method of claim 1, wherein the container body is comprised of a recycled material.

5. The method of claim 1, wherein the method further comprises singulation of one or more container bodies.

6. The method of claim 1, wherein the method further comprises formation of a lid, formation of the lid comprising:

receiving lid material;

shaping the lid material; and removing the shaped lid material to a secondary packaging process.

7. The method of claim 6, wherein the method further includes printing or stamping the lid material.

8. The method of claim 1, wherein the underside of the lid further comprises an adhesive.

9. The method of claim 1, wherein the second larger in width rim of the container body further comprises an adhesive.

10. The method of claim 1, wherein the second larger in width rim of the container body further comprises the polymer coating.

11. The method of claim 1, wherein the second larger in width rim of the container body and the lid are further comprised of the polymer coating.

12. The method of claim 1, wherein the lid is comprised of an aluminum foil material and polymeric coatings.

13. The method of claim 1, wherein the lid comprises an interior surface having a polymeric coating and an exterior surface having a printable surface.

14. The method of claim 1, wherein the method further comprises de-nesting of one or more lids.

15. The method of claim 1, wherein the convection heat sealing is accomplished by convection heating at a temperature range of 240 to 350 degrees Celsius, with a dwell time range of 0.4 second to 2.0 seconds, and an applied pressure of ~1200 N/m2.

16. The method of claim 1, wherein the method further comprises removing the container with a peelable lid having a frangible seal to a secondary packaging process.

17. The method of claim 1, wherein the pull tab extends across an entirety of the lid.

18. The method of claim 17, wherein the pull tab extends across a center of the lid.

* * * * *